United States Patent [19]

Altfather

[11] Patent Number: 4,811,721

[45] Date of Patent: Mar. 14, 1989

[54] WHEEL DRESSER

[76] Inventor: Walter R. Altfather, P.O. Box 154, Ekastown Rd., Sarver, Pa.

[21] Appl. No.: 65,278

[22] Filed: Jun. 22, 1987

[51] Int. Cl.[4] ..... B24B 53/00

[52] U.S. Cl. ..... 125/11 CD; 51/134.5 R

[58] Field of Search ..... 125/11 CD, 11 R, 11 B; 51/134.5

[56] References Cited

U.S. PATENT DOCUMENTS

| | | | |
|---|---|---|---|
| 1,184,853 | 5/1916 | Hobbs | 125/11 CD |
| 1,287,024 | 12/1918 | Hoy et al. | 125/11 CD |
| 1,394,704 | 10/1921 | Barnhart | 125/11 CD |
| 1,496,922 | 6/1924 | Conners | 125/11 CD |
| 1,506,655 | 8/1924 | Mirrielees | 125/11 CD |
| 1,562,941 | 11/1925 | Conners | 125/11 CD |
| 1,813,682 | 1/1924 | Shriver | 125/11 R |
| 2,442,172 | 5/1948 | Klockars | 125/11 R |
| 2,528,621 | 11/1950 | Sweetser | 125/11 CD X |
| 3,406,486 | 10/1968 | Bettcher | 51/5 |
| 3,481,319 | 11/1966 | Boyd, Jr. et al. | 125/11 R |
| 3,533,892 | 1/1971 | Sommer | 51/5 |
| 4,262,649 | 4/1981 | Espinosa | 125/11 B |
| 4,303,054 | 12/1981 | Lore | 125/11 R |
| 4,406,090 | 9/1983 | Schian et al. | 51/95 R |
| 4,520,788 | 6/1985 | Melvin | 125/11 CD |

*Primary Examiner*—Frederick R. Schmidt
*Assistant Examiner*—Shirish Desai
*Attorney, Agent, or Firm*—Nils H. Ljungman

[57] ABSTRACT

A wheel dresser for dressing and truing a driven grinding wheel, having a housing, a shaft rotatably mounted in the housing, a dressing wheel substantially nonrotatably affixed to the shaft, and dressing control knob apparatus for enabling operator supplied digital manipulation so as to initiate rotation of the dressing wheel and the shaft prior to contact of the dressing wheel with the driven grinding wheel and for thereafter enabling operator supplied digital manipulation so as to apply a braking action against rotation of the dressing wheel by the driven grinding wheel.

14 Claims, 3 Drawing Sheets

WHEEL DRESSER

BACKGROUND OF THE INVENTION

1. Field of the Invention:

The present invention relates to a wheel dresser for dressing and truing a driven grinding wheel, more particularly a wheel dresser which is in itself a rotating abrasive wheel, and most particularly to a rotating wheel dresser for dressing and truing diamond grinding wheels.

2. Description of the Prior Art:

The grinding wheel dressing tools which are known in the prior art are many and varied.

In some, such as those disclosed, for example, in U.S. Pat. No. 4,262,649 and U.S. Pat. No. 1,813,682, a simple pointed member such as a diamond tipped cutting tool is moved transversely across the rotating surfaces of the grinding wheel which is to be dressed.

Other prior art documents, e.g., U.S. Pat. No. 3,481,319 show the use of rotatable abrasive wheels for dressing and/or truing of driven grinding wheels.

All of the above-mentioned prior art documents are hereby expressly incorporated by reference into the present application as if the entire contents thereof were fully and expressly set forth herein.

Applicant is also aware of manufactured prior art wheel dressers which are essentially a simple, freely rotating, abrasive wheel which is clamped, magnetically or otherwise, in close proximity to the driven wheel which is to be dressed. Usually, the wheel dresser is positioned such that its rotational axis is offset by some angle (e.g., in the area of 30 to 40 degrees) to the rotational axis of the driven wheel which is to be dressed. Such angular offset produces a certain braking action such that the wheel dresser wheel rotates at a somewhat reduced velocity with respect to the driven wheel which is being dressed. This difference in rotational velocities produces an abrasive action whereby material may be gradually removed from the driven wheel being dressed so as to true the given wheel to a desired contour and/or remove binder material and thereby expose a fresh cutting surface, for example, in a diamond grinding wheel, a fresh lattice of diamond crystals.

In using such a prior art device, the operator positions the device in close proximity to the wheel which is being trued, flicks the freely rotating truing wheel to give it an initial rotational spin and then brings the truing wheel in contact with the driven wheel which is being dressed.

The two rotating surfaces are then translatably moved with respect to one another so as to remove a small amount of surface material and expose somewhat a fresh cutting surface. The process may then be repeated as many times as necessary to obtain the required degree of truing and exposure of a fresh surface.

In using such prior art devices, the operator may frequently place his hands in close proximity to a rapidly rotating and highly abrasive surface, thereby risking personal injury. Moreover, the operator has little means of influencing the degree of braking or resisting force which the truing device exerts on the driven wheel being dressed.

OBJECTS OF THE INVENTION

It is one object of the present invention to provide a truing device for dressing and truing a driven grinding wheel, the inventive truing device being highly reliable and safe in use.

It is another object of the present invention to provide such a truing device which, when operated by a skilled operator, is capable of quickly and thus efficiently removing material from a driven grinding wheel so as to expose a fresh cutting surface thereon and/or true the driven grinding wheel.

SUMMARY OF THE INVENTION

In one aspect, the invention features a wheel dresser for dressing and truing a driven grinding wheel, including: a housing; a shaft rotatably mounted in the housing; a dressing wheel substantially nonrotatably affixed to the shaft; and dressing control knob apparatus for enabling operator supplied digital manipulation so as to initiate rotation of the dressing wheel and the shaft prior to contact of the dressing wheel with the driven grinding wheel and for thereafter enabling operator supplied digital manipulation so as to apply a braking action against rotation of the dressing wheel by the driven grinding wheel.

In another aspect, the invention features a method for dressing and truing a surface of a driven grinding wheel, the method including the steps of: (a) providing a wheel dresser, the wheel dresser having: a housing; a shaft rotatably mounted in the housing; a dressing wheel substantially nonrotatably affixed to the shaft; and dressing control knob apparatus for enabling operator supplied digital manipulation so as to initiate rotation of the dressing wheel and the shaft prior to contact of the dressing wheel with the driven grinding wheel and for thereafter enabling operator supplied digital manipulation so as to apply a braking action against rotation of the dressing wheel by the driven grinding wheel; (b) rigidly affixing and positioning the wheel dresser adjacent the driven grinding wheel; (c) initiating rotation of the dressing wheel and the shaft through operator supplied digital manipulation of the dressing control knob apparatus; (d) moving the wheel dresser and the driven grinding wheel relative to one another to a first indexed position so as to cause contact therebetween; and (e) applying a braking action against rotation of the dressing wheel by the driven grinding wheel through operator supplied digital manipulation of the dressing control knob means.

These and other features of the present invention will now be explicitly set forth by way of a detailed description of a preferred embodiment, taken in conjunction with the accompanying drawings, wherein:

DESCRIPTION OF THE PREFERRED EMBODIMENT

Figure 1:
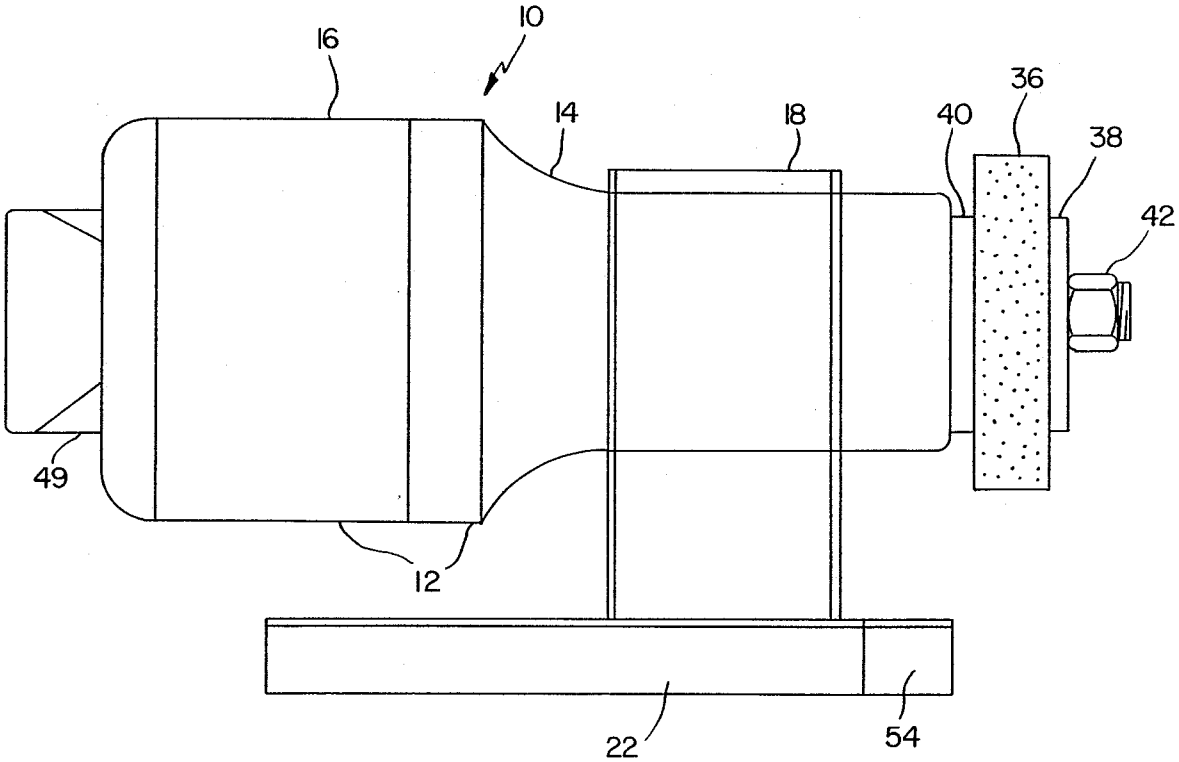
FIG. 1 is an elevational side view of a truing device constructed according to the present invention.
Figure 2:
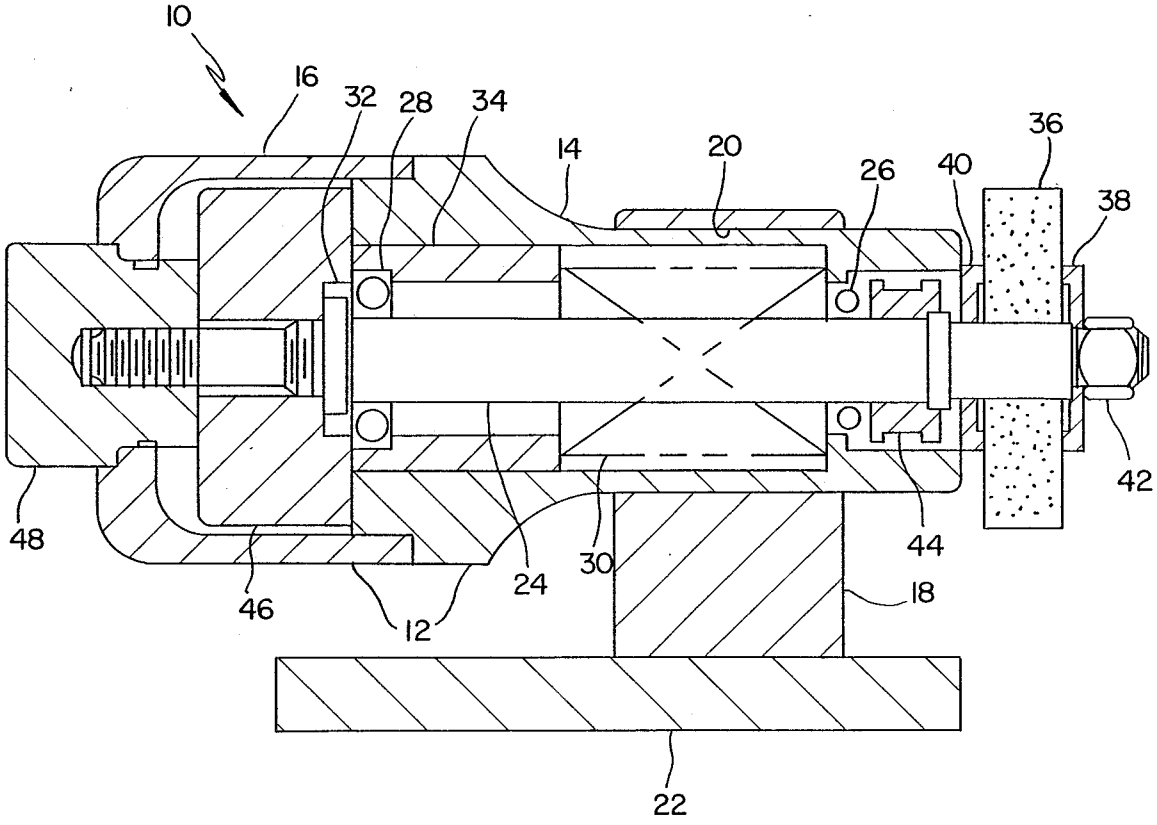
FIG. 2 is an elevational sectional view of the truing device of FIG. 1.

Referring first to FIGS. 1 and 2, the truing device 10 generally includes a housing 12 made up of a forward body portion 14 and a flywheel cover 16 detachably engaged therewith, an arc shaped body holder member 18 provided with a throughgoing hole 20 for encircling and supporting forward body portion 14 and a base plate 22 for supporting and positioning the entire truing device 10.

A shaft 24 is mounted longitudinally within housing 12 and supported for free rotation therein through the provision of a forward bearing assembly 26 and a rearward bearing assembly 28. Bearing assemblies 26 and 28 are biased away from one another by a spring 30, and the degree of biasing is made adjustable through provision of an adjustable locknut 32. A bearing retainer sleeve 34 is interposed between rear bearing assembly and spring 30.

An abrasive dressing wheel 36, preferably a carborundum wheel, is nonrotatably secured to shaft 24 adjacent its forward distal end and is flanked by a forward washer 38 and a rearward washer 40 and secured by a nut 42. A dust shield 44 encircles shaft 24 and is disposed rearward of dressing wheel 36 and within housing 12 so as to protect forward bearing assembly 26 from debris produced during operation.

Disposed within flywheel cover 16 and rigidly secured to shaft 24 there is provided a weighted flywheel 46 which ensures a smooth, continuous running action of the truing device.

Finally, secured to the rearward distal end of shaft 24 and partially protruding from flywheel housing 16 there is provided a dressing control knob 48 which is of generally cylindrical shape and is provided with a knurled surface 49 on at least a portion of its cylindrical periphery. Flywheel cover 16 and dresser control knob 48 are ergonomically designed and shaped so as to be comfortably grasped by the human hand for moving and positioning the truing device and so as to also comfortably support the hand of the operator, such that the operator's thumb can readily and easily apply a braking force to the peripheral surface of dresser control knob 48 and thereby effect the rate of material removal.

OPERATION

Figure 3:
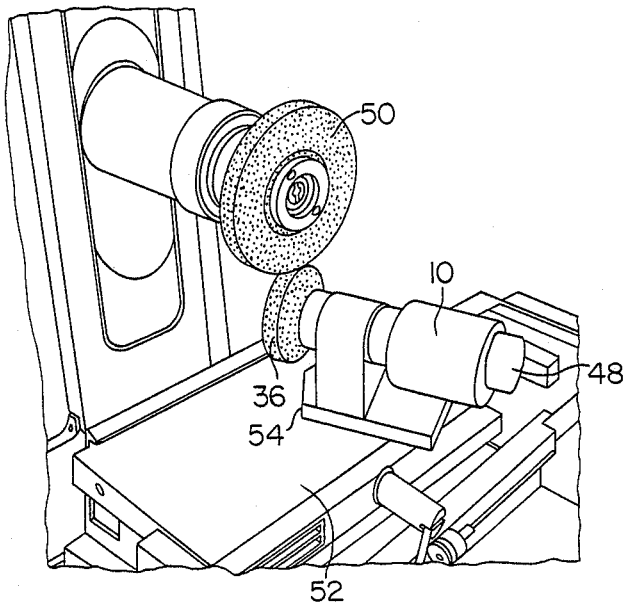
FIG. 3 is a perspective view of the truing device fo Figures 1 and 2 in use during the dressing and truing of a driven diamond grinding wheel.

FIG. 3 shows the operation of a truing device 10 constructed according to the present invention, wherein the truing device 10 is being used to dress and true the circumferential periphery of a diamond grinding wheel 50 which is provided with a magnetic chuck 52. It will be seen that truing device 10 is positioning and secured by magnetic chuck 52 such that its rotational axis is somewhat angularly offset from the rotational axis of the diamond grinding wheel 50. As noted above, such an angular offset produces a tangible braking force which serves to remove at least some material.

To dress the circumferential periphery of a diamond grinding wheel 50, such as is shown in FIG. 2, the operator first rigidly positions the truing device 10 adjacent the diamond grinding wheel 50. The dressing wheel 36 is then given an initial degree of rotational velocity by the operator through manipulation of dresser control knob 48. The diamond grinding wheel 50 and the abrasive dressing wheel 36 are then brought into contact, and translatory movement between the two wheels is effected, e.g., through transverse translation of the magnetic chuck 52, such that the contact point between the two wheels moves over the entire peripheral circumference of diamond grinding wheel 50.

During such a grinding "pass", the operator optionally applies additional braking force and controls such braking force applied by simply pressing his thumb against dresser control knob 48. It has been discovered that an experienced operator can dress and true a grinding wheel much more efficiently when he can easily and safely adjust the braking force and, therefore, the degree of material removal, as in the present invention. Moreover, the area of removal is often visible in the form of a color or shading variation appearing at the contacted surfaces, thus enabling the operator to determine the progress and degree of completion of the operation.

The truing device of the present invention may also be employed to dress and true the sidewalls of driven grinding wheels.

Referring back to FIG. 1, base plate 22 is provided with side relieved portions 54 at its forward extremity adjacent abrasive dressing wheel 36. In the present preferred embodiment, side relieved portios 54 consist of two facets cut into base plate 22 such that its forward portion is wedge shaped.

In side dressing a driven grinding wheel, truing device 10 is positioned such that its forward peripheral edge will contact the side wall of the wheel to be dressed. Successive passes over the side wall, e.g., in a radial direction, are then performed, with the operator imparting an initial spin to the truing device 10 and controlling the braking action through manipulation of dresser control knob 48 substantially as descriped above.

While the present invention has been disclosed by way of a particular preferred embodiment, various substitutions of equivalents may be effected without departing from either the spirit or the scope of the invention as set forth in the following claims:

What is claimed is:

1. A wheel dresser for dressing and truing a driven grinding wheel, comprising:

a housing;

a shaft rotatably mounted in said housing; a dressing wheel substantially nonrotatably affixed to said shaft; and rotatable dressing control knob means for rotating with said dressing wheel and for enabling operator supplied digital manipulation so as to initiate acceleration and rotation of said dressing wheel and said shaft prior to contact of said dressing wheel with said driven grinding wheel and for thereafter enabling operator supplied digital manipulation of said rotatable dressing control knob means so as to apply a selectively variable braking action against rotation of said dressing wheel by said driven grinding wheel.

2. The wheel dresser according to claim 1, further comprising a flywheel substantially nonrotatably attached to said shaft, and wherein said dressing wheel is substantially nonrotatably attached to said shaft adjacent a first distal end therof, wherein said flywheel and said dressing control knob means are nonrotatably attached to said shaft adjacent a second distal end thereof.

3. The wheel dresser according to claim 1, wherein said dressing control knob means comprises a substantially cylindrical knob member which projects through said housing and wherein the exterior portion of said housing adjacent said knob member is shaped so as to be comfortably grasped by the human hand.

4. The wheel dresser according to claim 2, wherein said dressing control knob means comprises a substantially cylindrical knob member which projects through said housing and wherein the exterior portion of said housing adjacent said knob member is shaped so as to be comfortably grasped by the human hand.

5. The wheel dresser according to claim 3, wherein said cylindrical knob member has a circumferential wall, at least a portion of which is knurled.

6. The wheel dresser according to claim 4, wherein said cylindrical knob member has a circumferential wall, at least a portion of which is knurled.

7. The wheel dresser according to claim 1, wherein said driven grinding wheel also includes a chuck plate and wherein said wheel dresser further comprises magnetic baseplate means for magnetically affixing and positioning said wheel dresser to said chuck plate.

8. The wheel dresser according to claim 2, wherein said driven grinding wheel also includes a chuck plate and wherein said wheel dresser further comprises magnetic baseplate means for magnetically affixing and positioning said wheel dresser to said chuck plate.

9. The wheel dresser according to claim 3, wherein said driven grinding wheel also includes a chuck plate and wherein said wheel dresser further comprises magnetic baseplate means for magnetically affixing and positioning said wheel dresser to said chuck plate.

10. The wheel dresser according to claim 5, wherein said driven grinding wheel also includes a chuck plate and wherein said wheel dresser further comprises magnetic baseplate means for magnetically affixing and positioning said wheel dresser to said chuck plate.

11. The wheel dresser according to claim 7, wherein said chuck plate of said driven grinding wheel comprises a magnetic chuck plate, wherein said magnetic baseplate means comprises a plate member of ferromagnetic material, and wherein said plate member is side relieved proximate said dressing wheel so as to allow side dressing of said driven grinding wheel.

12. The wheel dresser according to claim 10, wherein said chuck plate of said driven grinding wheel comprises a magnetic chuck plate, wherein said magnetic baseplate means comprises a plate member of ferromagnetic material, and wherein said plate member is side relieved proximate said dressing wheel so as to allow side dressing of said driven grinding wheel.

13. The wheel dresser according to claim 2, further comprising:

a dust shield encircling said shaft and disposed adjacent said dressing wheel;

first and second bearings disposed adjacent said dust shield and said flywheel, respectively;

biasing means for biasing said first and second bearings apart; and locknut biasing adjustment means for adjusting the amount of bias exerted by said biasing means.

14. A wheel dresser for dressing and truing a driven grinding wheel, comprising:

a housing;

a shaft rotatably mounted in said housing;

a dressing wheel substantially nonrotatably affixed to said shaft;

rotatable dressing control knob means for rotating with said dressing wheel and for enabling operator supplied digital manipulation so as to initiate acceleration and rotation of said dressing wheel and said shaft prior to contact of said dressing wheel with said driven grinding wheel and for thereafter enabling operator supplied digital manipulation of said rotatably dressing control knob means so as to apply a selectively variable braking action against rotation of said dressing wheel by said driven grinding wheel;

a flywheel substantially nonrotatably attached to said shaft, said dressing wheel being substantially nonrotatably attached to said shaft adjacent a first distal end thereof, and said flywheel and said dressing control knob means being nonrotatably attached to said shaft adjacent a second distal end thereof;

said dressing control knob means comprising a substantially cylindrical knob member which projects through said housing and wherein the exterior portion of said housing adjacent said knob member is shaped so as to be comfortably grasped by the human hand;

said cylindrical knob member having a circumferential wall, at least a portion of which is knurled; said driven grinding wheel also including a chuck plate and said wheel dresser further comprising magnetic baseplate means for magnetically affixing and positioning said wheel dresser to said chuck plate;

said chuck plate of said driven grinding wheel comprising a magnetic chuck plate, said magnetic baseplate means comprising a plate member of ferromagnetic material, and said plate member being side relieved proximate said dressing wheel so as to allow side dressing of said driven grinding wheel;

a dust shield encircling said shaft and disposed adjacent said dressing wheel;

first and second bearings disposed adjacent said dust shield and said flywheel, respectively;

biasing means for biasing said first and second bearings apart; and locknut biasing adjustment means for adjusting the amount of bias exerted by said biasing means.

* * * * *